US008196873B2

(12) United States Patent
Kohn et al.

(10) Patent No.: US 8,196,873 B2
(45) Date of Patent: Jun. 12, 2012

(54) BAG DISPENSER

(75) Inventors: Albert Kohn, Woodmere, NY (US); Johan Blok, Perthamboy, NJ (US)

(73) Assignee: Broadway Kleer-Guard Corp., Edison, NJ (US)

( * ) Notice: Subject to any disclaimer, the term of this patent is extended or adjusted under 35 U.S.C. 154(b) by 9 days.

(21) Appl. No.: 11/633,370

(22) Filed: Dec. 4, 2006

(65) Prior Publication Data

US 2007/0176058 A1 Aug. 2, 2007

Related U.S. Application Data

(63) Continuation-in-part of application No. 11/215,450, filed on Aug. 30, 2005, now abandoned, which is a continuation-in-part of application No. 11/068,708, filed on Mar. 1, 2005, now abandoned.

(51) Int. Cl.
*B65B 67/04* (2006.01)

(52) U.S. Cl. ..... 248/100; 248/95; 248/153; 383/19

(58) Field of Classification Search ..... 248/95, 248/99, 97, 100, 153; 220/485, 495.06; 383/9, 383/37; 221/26, 45; 211/106, 59.1, 12
See application file for complete search history.

(56) References Cited

U.S. PATENT DOCUMENTS 965,431 A * 7/1910 Bellows ..... 206/449
3,312,339 A 4/1967 Dinges
3,454,166 A 7/1969 Dinges
3,861,125 A * 1/1975 Hagemeister ..... 53/390
4,199,122 A * 4/1980 Christie ..... 248/97
4,503,561 A 3/1985 Bruno
4,699,607 A 10/1987 Lambrecht
4,717,262 A 1/1988 Roen et al.
4,734,148 A 3/1988 Meyer
4,769,126 A 9/1988 Roen et al.
4,854,451 A 8/1989 Jensen
4,863,125 A * 9/1989 Bateman ..... 248/97
5,062,716 A 11/1991 Conrad et al.
5,100,000 A 3/1992 Huseman
5,170,957 A * 12/1992 Carpenter ..... 242/588.3
5,184,728 A 2/1993 Wile
5,301,832 A 4/1994 Daniels
5,332,097 A 7/1994 Wile
5,419,437 A 5/1995 Huseman
5,636,809 A * 6/1997 Koch ..... 242/422.5
5,727,721 A * 3/1998 Guido et al. ..... 225/106
5,871,115 A * 2/1999 Kohn ..... 220/485
5,950,818 A * 9/1999 Paulsen ..... 206/205
5,971,155 A 10/1999 Liang
6,007,244 A 12/1999 Dinder
6,089,514 A * 7/2000 Huang et al. ..... 248/99
6,193,058 B1 2/2001 Yacko et al.
6,325,214 B1 * 12/2001 Smithson ..... 206/554
6,364,105 B1 4/2002 Yacko et al.
6,543,638 B2 * 4/2003 Wile ..... 221/1
6,685,075 B1 * 2/2004 Kannankeril ..... 225/96
6,702,460 B1 * 3/2004 Geyer ..... 383/5
6,718,738 B2 4/2004 Huseman
6,722,378 B2 * 4/2004 Heiberg et al. ..... 134/166 R
6,729,483 B1 * 5/2004 Nguyen et al. ..... 211/163
7,128,251 B1 * 10/2006 Galle ..... 225/2

(Continued)

*Primary Examiner* — Nkeisha Smith
(74) *Attorney, Agent, or Firm* — Philip M. Weiss; Weiss & Weiss

(57) ABSTRACT

An apparatus for supporting and dispensing bags and a method for dispensing a bag from the dispenser.

22 Claims, 9 Drawing Sheets

U.S. PATENT DOCUMENTS

| | | | | |
|---|---|---|---|---|
| 7,404,531 | B2 * | 7/2008 | McConnell | 248/95 |
| 7,424,963 | B2 * | 9/2008 | Daniels | 225/93 |
| 2002/0145086 | A1 * | 10/2002 | Alvarado et al. | 248/95 |
| 2006/0078232 | A1 * | 4/2006 | Trinko | 383/37 |
| 2007/0186515 | A1 * | 8/2007 | Ruetten et al. | 53/502 |

* cited by examiner

BAG DISPENSER

RELATED APPLICATIONS

This application is a continuation-in-part of patent application Ser. No. 11/215,450 filed on Aug. 30, 2005, now abandoned which is a continuation-in-part of patent application Ser. No. 11/068,708 filed Mar. 1, 2005 now abandoned.

FIELD OF THE INVENTION

The present invention relates to an apparatus for supporting and dispensing bags and a method for dispensing a bag from the dispenser.

BACKGROUND OF THE INVENTION

Retail establishments typically use a plurality of different size bags for packaging their products sold to consumers. The bags are usually stored on a shelf or other support member provided for all sizes and shapes of bags.

In the prescription drug area conventional practice is to use paper bags for the distribution of products. These bags are opaque. They do not stand up by themselves, and must be held up manually when placing products in the bag.

U.S. Pat. Nos. 5,184,728 and 5,332,097 to Wile teach a plurality of the same size bags being held on a hook located inside of a paperboard cartridge. The bags are of the "T-shirt" type having perforations in the lip so the bags can be torn off of the hook.

U.S. Pat. No. 5,301,832 to Daniels teaches a rack for dispensing plastic bags. Various size bags are draped over a rod and held on stationary wire loop hooks. Each of the various size bags are disposed one on top of each other to form a stack of bags such that the body portions of the bags connected to the bag handles form a stack on the rod. Because of this arrangement, Daniels must provide lubricous surfaces on each of the bags so that the bags located in the stack do not adhere to an adjacent bag when being removed from the rod. In addition, after the bags are draped over the rod, the closure portions of each of the different size bags must be attached to a specific one of the hook loops which makes the mounting of the bags in the bag holder difficult. Furthermore, the top bags must be removed in order to replace the bottom bags.

Million, U.S. Pat. No. 3,312,339 and Dinges, U.S. Pat. No. 3,454,166, merely teach wickets for holding plastic bags having a pair of holes near the handles. With the device of Dinges, two different size bags are placed under the same hooks. Because the two different size bags are stacked on top of each other in Dinges, a large bag being removed has a tendency to adhere to an adjacent smaller bag and inadvertently remove several of the adjacent smaller bags. This effectively limits the number of different size bags to be held by the Dinges device. Furthermore, the top bags must be removed in order to replace the bottom bags. In addition, the wickets in both the Million and Dinges devices must be removed from a support base to mount additional bags on the wickets.

U.S. Pat. No. 5,871,115 relates to an apparatus for supporting and dispensing articles such as bags, and more particularly plastic "T-shirt" type bags having perforations allowing the bags to be easily removed from the apparatus.

U.S. Pat. No. 5,419,437 relates to a snap and fill plastic film bag and a process of opening and placing product in the plastic bags. A reclosable zipper is provided at the opening of the bag leading to the bag cavity. A lip extends from the front wall above the reclosable zipper and a header portion extends from the back wall above the reclosable zipper. A part of the header portion is supported on a support structure for carrying the bag and a perforation is provided on the header portion above the reclosable zipper. The bags are initially closed and, during the process of opening and placing the product therein, the operator grips the bag front wall lip and by pulling the lip away from the support structure, the zipper profiles are separated and opens the bag. Further pulling of the lip from the support structure causes the severing of the bag from the header portion at the perforation.

U.S. Pat. No. 5,062,716 relates to a staged release bag formed of a thermoplastic film material having multiple layers and having discrete cuts formed therein including wicket holes, stabilizing cuts and release paths, and which is useful in an automated packaging operation, and a method for making said bag from a continuous tube or sheet of plastic material.

U.S. Pat. No. 4,503,561 relates to a bag made of thin pliable plastic film, including panels having slits formed therein, the slits of the bag being formed to extend in a first direction, and the slits on a relatively facing panel having slits formed to extend in a direction transverse to said first direction.

U.S. Pat. No. 5,971,155 relates to a quickly accessible and fillable plastic bag unit, which includes a spacer unit having two layers, and a plastic bag having front and back walls which are joined together, and a pair of complementary separable zipper halves which are provided respectively on the front and back walls and which are spaced apart from the spacer unit at a predetermined distance. The plastic bag unit has an aperture unit formed through an intermediate portion of the spacer unit, two narrower outer uncut spaces which are respectively adjacent to the longitudinal sides of the plastic bag and which connect the spacer unit to the front and back walls, and two wider inner uncut spaces which are respectively adjacent to the aperture unit and which connects the spacer unit to the front and back walls.

U.S. Pat. No. 6,007,244 relates to a plastic film bag assembly which includes a recloseable plastic film bag made up of a front wall and back wall joined together and having complementary detachably attachable zipper profiles at the bag opening. A lip extends from the front wall above the zipper profiles. A header extends above the back wall above the zipper profiles. A hole is provided through the header at a distance from the header perimeter edge and defining a severable header portion between the hole and the perimeter edge.

U.S. Pat. No. 4,699,607 relates to a method and apparatus for producing thermoplastic bags from an elongate web. An apparatus for feeding the web includes devices for producing mounting holes and perforations along a circular path surrounding the holes. The web is severed and sealed to produce sheets containing a mounting hole encircled by the perforations. A selected number of successive sheets are impaled on a post projecting through the holes. A stack having a selected number of sheets is accumulated on a post fixed to a support supporting a medial zone of the sheets which are combined by a heated punch penetrating the sheets in the area enclosed by the perforations.

U.S. Pat. No. 4,734,148 relates to a stack of interlocked detachable bags, formed from a thermoplastic foil strip, and each comprising two walls, a front wall and a back wall, preferably at least one handle-shaped incision positioned on one of said walls adjacent an upper filling opening, wherein the individual bags each have an interlock piece and are attached together with the aid of at least one interlock means engaging their interlock pieces, and by means of a row of perforations forming an edge of the interlock piece the individual bags are detachable from the interlocked stack by tearing off.

U.S. Pat. No. 5,100,000 relates to a suspendable bag adapted for suspending on a structure and opening, filling, and severing away therefrom. A suspension wall extends from the bags and includes suspension holes adapted to receive suspension pegs located on the structure. A score line is provided below the suspension holes and a support hole is provided below the score line and above the bag. The support hole is adapted to receive a support bag located on the structure. During operation, the support hole, in conjunction with the support peg, allows the opening of a reclosable zipper at the mouth of the bag by pulling on a lip connected to the front wall of the bag. The support hole, in conjunction with the support peg, further supports the back portion of the bag while the bag is being filled with various products.

U.S. Pat. Nos. 6,193,058 and 6,364,105 relate to a liquid dispensing bag that has a sealed concentrate pouch and a mixing pouch, the concentrate pouch having a fluid tight seal separating the concentrate pouch from the mixing pouch, and the concentrate pouch containing a base material at a first concentration.

U.S. Pat. No. 4,854,451 relates to a block of side-gussetted, bottom-weld bags. Each bag has an opening on one side to facilitate the removal of individual bags from the block.

U.S. Pat. No. 6,718,738 relates to a plastic bag film assembly which includes a bag having front and back walls joined together and defining an opening leading to a cavity. A header portion extends from the back wall for supporting the bag on a structure. A severance line extends across the header and includes tear sections extending inwardly from each of the header side edges. The severance line also includes support sections adjacent and inwardly of the tear sections.

U.S. Pat. No. 4,769,126 relates to a bottom gusset bag pad arrangement for liquid containers. The bag pad arrangement is made from tube stock, for bagging a pair of liquid containers, such as containers for carry out for milk shakes, carbonated drinks, that are at fast food outlets, for carry away by the customer, in which the bag pads are all the same and are incorporated in the pad in congruent relation. Each bag has a bottom fold that is gusseted for flat bottom shaping when open, front and back panels extending between side end seals that extend normally of the bag bottom that are spot welded together at the center of the bag but spaced from the bottom gusset thereof, and that define rectilinear side edgings forming the upper corners of the respective bags that extend to the bag end seals adjacent to but spaced from the bottom gusset thereof, and aligned handle forming openings formed in the bag front and back panels adjacent the upper end of each bag. The back panel of each bag includes a projecting flange that extends beyond the top edging of the bag front panel which is free of the back panel to form the mouth of each bag. The bag back panel flange includes a score line and the bags of the pad are united in pad form by heat welding the bags together at the top edging of the back panel flange, with a pad mounting hole being formed in the pad bag back panel flanges.

U.S. Pat. No. 4,717,262 relates to a flat bottom plastic bag having two sided panel construction with the bottom of the bag formed by a gusset extending between the sealed ends of the bag, at which point the bag side panels are joined together, with the bag bottom gusset having a central fold line that is, in the flattened relation of the bag, disposed between the lower portions of the bag side panels, and that in such relation forms a first pair of adjacent bag plies that includes one of said bag side panel lower portions, and a second pair of bag plies that includes the lower portion of the other bag side panel, with said respective sets of bag plies being respectively joined together but free of adherence to each other by diagonally extending heat seals on either side of the bag that extend diagonally from the bag respective ends in converging relation to adjacent the respective bottom edges of the bag that are defined by the respective bag plies.

SUMMARY OF THE INVENTION

The present invention relates to an apparatus for supporting and dispensing a bag comprising a dispenser which has a surface for supporting a bag, a member attached to the bag supporting surface for holding a plurality of bags on the dispenser and a bag flap opener.

The present invention relates to an apparatus for supporting and dispensing a bag comprising: a dispenser which includes a plurality of interconnected rails arranged to define a bag supporting surface; a hook member attached to the bag supporting surface and a bag flap opener. It is an object of the present invention for the bags to be plastic. It is an object of the present invention for the bags to be Rx bags. It is an object of the present invention for the dispenser to support and dispense a plurality of different size bags. It is an object of the present invention for the dispenser to have bag hooks attached to a top set of rails on the wire frame dispenser. It is an object of the present invention for a second set of bag hooks to be attached to the bottom set of rails.

It is an object of the present invention for the body portion of the dispenser to be arranged to support the hooks for holding the bags and the bags themselves. It is an object of the present invention for the hooks to be adapted to be mounted on and removed from the body portion of each dispenser.

It is an object of the present invention for the dispenser body to be formed by a plurality of pairs of rails extending between end portions of the dispenser. The hooks have a shape that enables the hooks to snap fit onto adjacent rails. The hooks may be placed in a variety of positions on adjacent rails to adjust to different size lengths and widths of bags. It is an object of the present invention for the hook member to have a snap-fitting shape provided by a curved lip portion and a rod grasping member which at least partially grasps a rail.

Alternatively, the hooks may have other suitable rail grasping members and attaching members for removably connecting the hooks to the dispenser body.

It is an object of the present invention for the bags to be held by a spring loaded clamping mechanism instead of hooks.

It is an object of the present invention for the dispenser to be of a one piece construction with one or two tiers. It is an object of the present invention for the dimensions of the dispenser to be approximately 8 inches wide, approximately 6 inches high including the hooks and approximately 12 inches long.

It is an object of the present invention for the dispenser to comprise a spring loaded bag flap opening bar with or without a hinged flat plate, being lifted before placing bags onto the bag hook. It is an object of the present invention to have the flat plate hinged on the flap opening bar so that it automatically adjusts to the proper angle for the amount of bags stacked on the dispenser. It is an object of the present invention for the flap opener to be located on both of the top and bottom tiers.

It is an object of the present invention for the dispenser to comprise a spring loaded bag flap opening bar with an offset center portion which makes it easier to grasp when lifting before placing the bags under the bar and onto the bag hooks. It is an object of the present invention that this offset center portion of the flap opening bar allows the handle area of the bag to pass freely under the bar without catching under the bar.

It is an object of the present invention for the dispenser to be loaded with two sizes of bags on snap-on bag hooks.

It is an object of the present invention to comprise an elevated guide bar just behind the flap opening bar to assist in separating the front edge of the flap from the body of the bag.

It is an object of the present invention for the spring loaded flap opener to lift the flap as it is being pulled off the dispenser one at a time. The flap will stay open to allow the product to be easily placed into the front pocket of the bag.

It is an object of the present invention that after the object or prescription is placed into the pocket of the bag, the flap is turned back down and stapled or taped securely closed.

It is an object of the present invention for the dispenser to be placed on top of or under a check out counter in a minimum of space. It is an object of the present invention for hardware to be included with the dispenser to allow the dispenser to hang vertically on a wall or the back of a check out counter. Bags will dispense one at a time as they are pulled off the header portion of the bag which will remain on the bag hook until the entire "gang" of 50 or more bags has been depleted. Each size is accessible to load without having to remove the other size bag.

It is an object of the present invention for the dispenser to have a recessed open portion, wherein the dispenser is placed on a counter or shelf with the recessed open portion of the dispenser placed at the front.

The present invention relates to a method of supporting and dispensing bags comprising: loading bags on a dispenser, by lifting a bag flap opening bar and placing the bags underneath a bag flap opening bar. The bags are placed on a hook member. A user pulls the bags under the bag flap opening bar, which lifts a flap of the bag as the bag is pulled off the dispenser one at a time. It is an object of the present invention for the flap to stay open once it is pulled off the dispenser to allow product to be placed into a front pocket of the bag easily.

It is an object of the present invention for the method to further comprise: placing an object into a pocket below the flap and turning the flap back down thereby closing the flap over the opening of the pocket. It is an object of the present invention for the flap to be closed by stapling or taping the flap to the bag.

The bags may comprise stand-alone dispensable bags for packaging prescription drugs, cosmetics, and small objects. The bag has a flap which covers an opening in the front or back of the bag. The bag can be filled by lifting the flap and placing the objects into the front or back pocket beneath the flap. The flap is then closed. One can staple the flap securely to keep objects from falling out of the bag. It is an object of the present invention to provide a sealing means to seal the flap to the bag. It is an object of the present invention to provide a snap or other closing means to close the flap to the bag. It is an object of the present invention to provide handles which are separated by a seal above the flap. It is an object of the present invention for the handles to be cut out handles. It is an object of the present invention for the handles to not affect the opening of the bag. It is an object of the present invention to provide a die cut handle above a seal which separates the flap and the body of the bag from the handle.

It is an object of the present invention for the bag to have tear-off perforations so that the bag can be removed from a dispenser. The bag has slits above the tear-off perforations so that the bag can be hung on hooks. It is an object of the present invention for the bag to have a bottom gusset so the bag can flatten out on the bottom. It is an object of the present invention for the bag to have a width of approximately 5" to 7" and a height of approximately 11" to 13". It is an object of the present invention for the bottom gusset to be approximately 2" so that the bag can flatten out on the bottom.

It is an object of the present invention to provide a method of point of purchase printing for packaging prescription drugs, cosmetics and other small objects comprising: placing multiple gangs of plastic bags having a width between about 5" and 7" and a height of between about 11" and 13" on a dispenser. The bag is removed from the dispenser by means of tear off perforations. Prescription drugs, cosmetics, or other small objects are placed in the bag and the bag is closed.

A stand alone bag is defined as a bag that can stand up by itself when opened. It is an object of the present invention for the bags to be made of high density polyethylene. It is an object of the present invention for the bags to stand on their own without any additional support.

It is an object of the present invention for the bag to be attached at the top edge to a header which keeps a gang of 50-100 bags together for use with a dispenser. It is an object of the present invention for a header to hold the bags together. It is an object of the present invention for the bag to have slits above the tear off perforations so that the bag can be hung on the hooks. It is an object of the present invention for the bag to have a die cut handle. It is an object of the present invention for the die cut handle to go through the front and back panels of the bag.

It is an object of the present invention for the bag to have an indicator for showing a user where to close the bag after a product is placed in the bag. It is an object of the present invention for the bag to have a device for closing the bag after a product is placed in the bag. This device or closing mechanism can be an adhesive, zip-lock or other type of closure mechanism.

BRIEF DESCRIPTION OF THE DRAWINGS

Throughout the following views, reference numerals will be used in the drawings, and the same reference numerals will be used throughout the several views and in the description to indicate same or like parts of the invention.

DETAILED DESCRIPTION OF THE INVENTION

Figure 1:
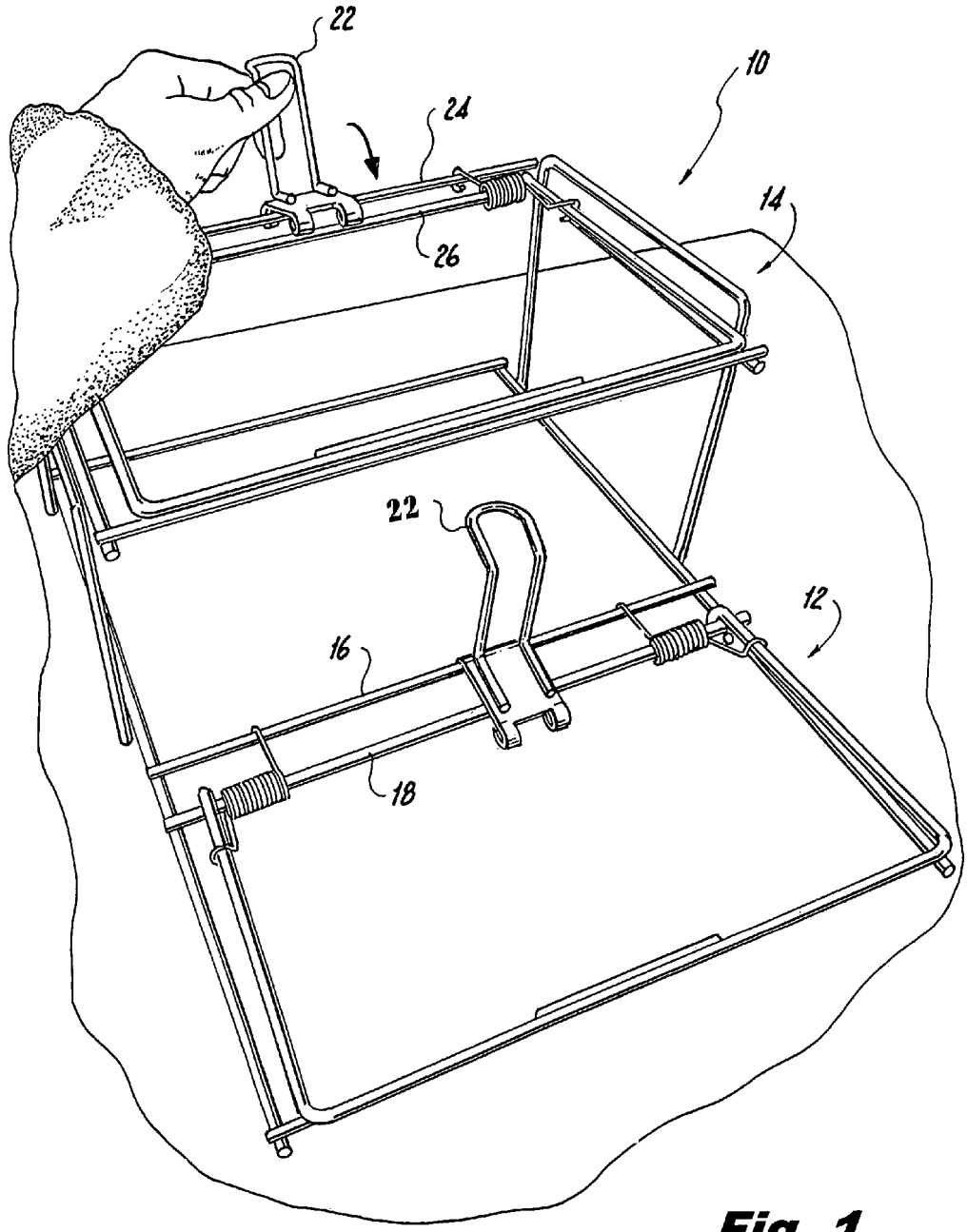
FIG. 1 shows a top view of the dispenser of the present invention with a bag hook being placed on the top set of bag hook rails.

The present invention relates to a bag supporting and dispensing apparatus. The bag supporting and dispensing apparatus includes a rack for holding and dispensing bags, preferably bags having perforations at the lips thereof to allow the bags to be removed one-by-one from the apparatus. The rack is preferably formed from a plurality of interconnected rail members. The rack may be formed of steel, aluminum, any other suitable metal, plastic, wood, and any other suitable material.

The rack includes a front portion. The rack can be placed on a counter or shelf with the recessed portion of the rack placed at the front.

In a preferred embodiment, the rail members provide elevation to the rack so that the hook members are easily removed and attached to the rack without interfering with the surface beneath the rack. Further, the rail member is designed to allow the mounting member to grasp a rail without interfering with the attachment of hook members.

In an embodiment, a single rack has a plurality of bags being held on a hook member. The hook member is arranged so that the bags hang over the front of the rack open portion. The location of the hook members can be adjusted to accommodate various sizes of bags. It is preferred that short bags are placed on adjustable hooks on horizontal rails that are on the top tier of the rack. Bags that are longer are placed on adjustable hooks on horizontal rails on the bottom tier of the rack. Bags are preferably loaded onto the hook members in gangs of the same size. The bags are torn off the hooks one at a time at perforations.

The bag of the present invention is dispensable from a plurality of hooks. In an embodiment, the bag of the present invention is made of high density polyethylene.

In an embodiment of the present invention the bags are attached at the top edge to a header which keeps a gang of 50-100 bags together for use with a dispenser. In an embodiment of the present invention a header holds the bags together. The bags have a means for separating the bags from the dispenser. In an embodiment, the bags have tear-off perforations so that the bags can be removed from the dispenser. In an embodiment, the bag has slits above the tear off perforations so that the bag can be hung on the hooks. In an embodiment, the bag has a bottom gusset so the bag can flatten out on the bottom. In an embodiment, the bag has die cut handles.

In an embodiment, the bag has a flap which when opened allows objects to be placed inside the bag. The flap can then be closed. In a preferred embodiment the flap is securely attached to the bag once the objects are placed inside. In an embodiment the flap is attached to the bag by a staple. In an embodiment the flap is attached to the bag by a sealing mechanism such as a zip lock, adhesive, or snap fit. In an embodiment the flap is placed on the bag below a sealing mechanism which separates the bag opening from the handles on the bag.

In an embodiment, the bag has slits which are used to be hung on a dispenser. A header holds the bags together. The bags are removed from the dispenser by tear-off perforations. The bag has tear-off perforations and has a die cut handle. The bag has a die cut handle for allowing the user to hold the bag. The bag has a seal which separates the handle from the bottom of the bag. A front flap is located below the seal. Once the front flap is lifted up an opening allows a user to place objects inside of the bag. The bag further has a bottom gusset.

Referring now to the drawings, an embodiment of a dispenser of the invention generally designated with the numeral 10, is shown in FIG. 1.

FIG. 1 shows a bag hook 22 being attached to a set of rails 24 and 26 on the wire frame dispenser 10. A second bag hook 22 is attached to a set of rails 16 and 18. The dispenser 10 shown in FIG. 1 has two tiers 12 and 14.

Figure 2:
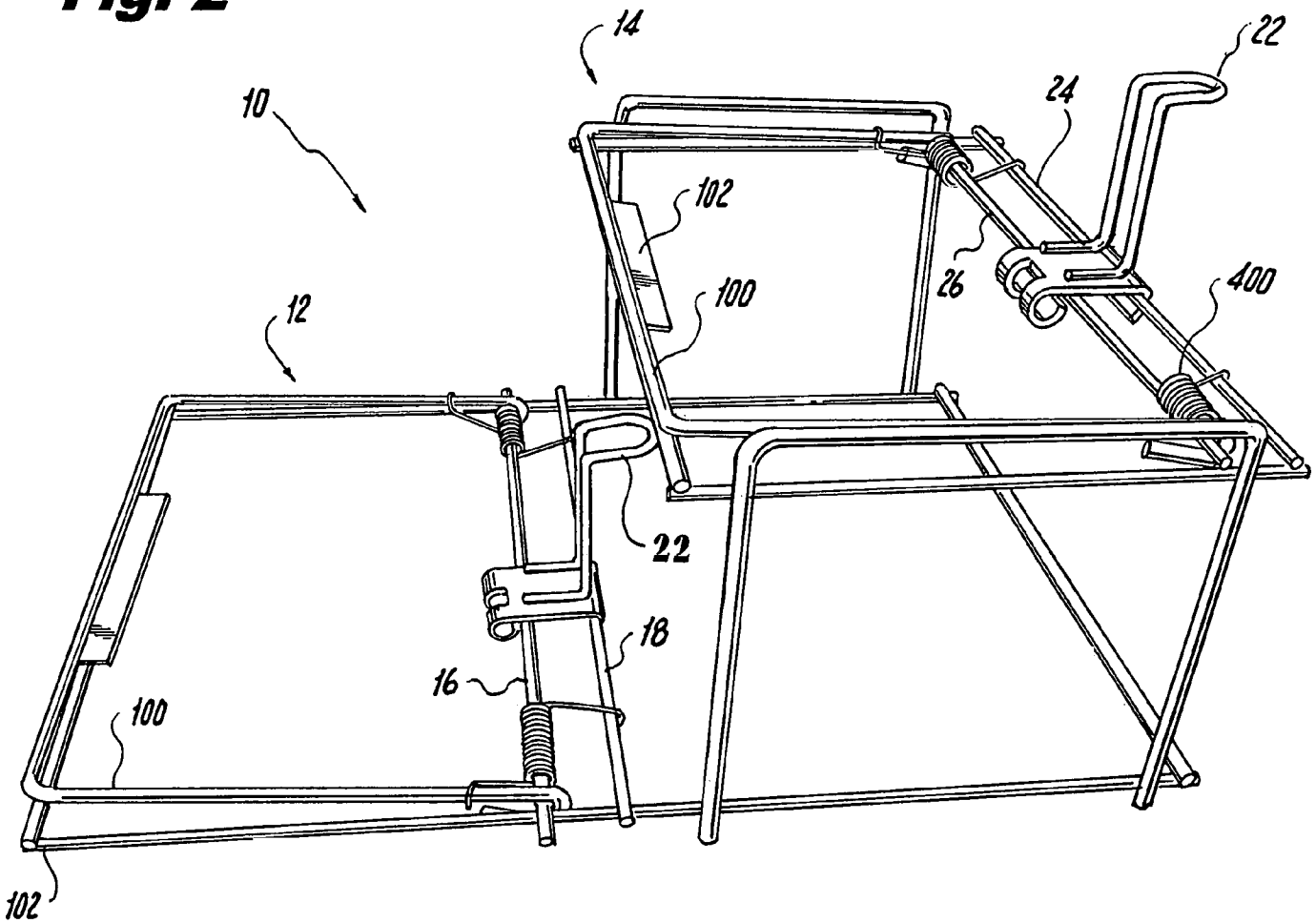
FIG. 2 is a side view of the dispenser of the present invention with bag hooks and hinged flat plates on both top and bottom tiers.

FIG. 2 shows a side view of the dispenser 10 shown in FIG. 1. The dispenser has a spring 400 loaded flap opening bar 100 for opening the flap of a single bag. A flat plate 102 is hinged to the bar 100 so that its angle will change depending on the amount of bags loaded onto the dispenser 10. The spring 400 loaded bag flap opening bar 100 and the flat plate 102 are each in each of the tiers 12 and 14.

Figure 3:
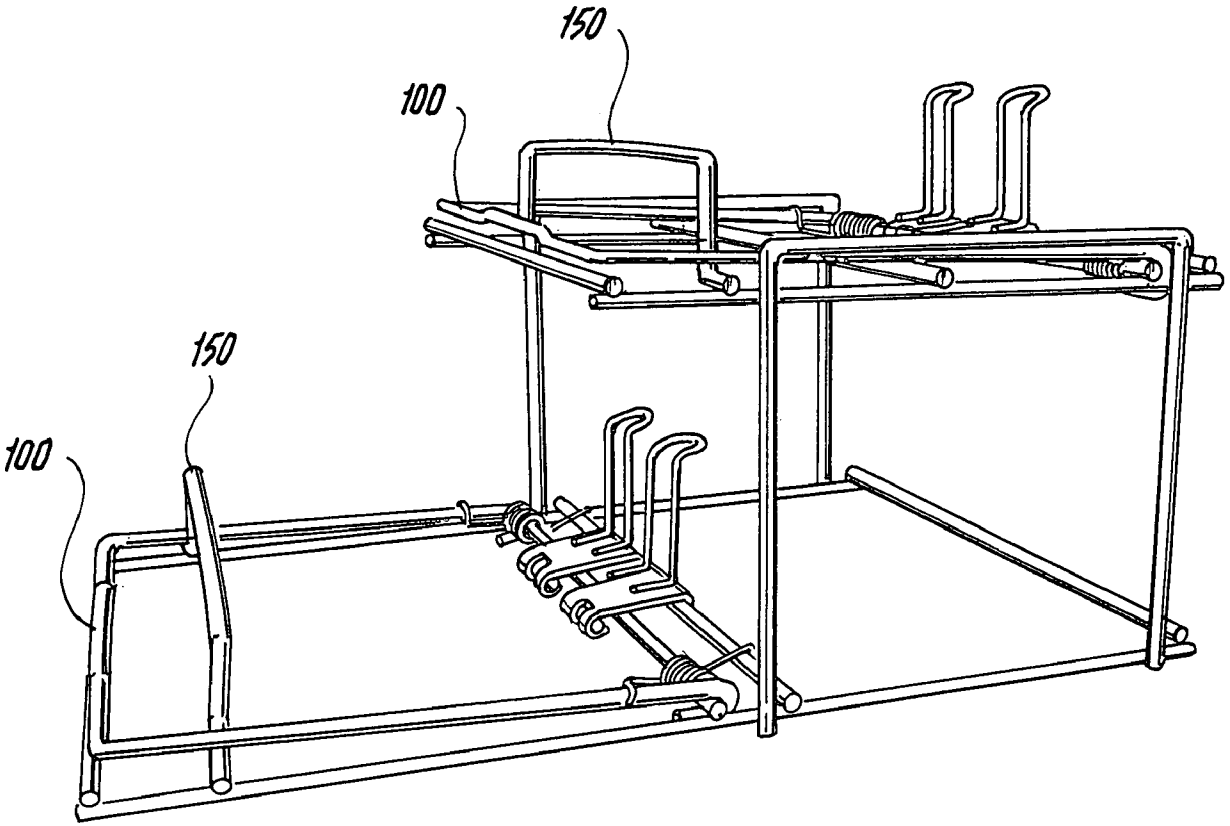
FIG. 3 shows a side view of the dispenser with the elevated guide bars and two bag hooks on both top and bottom tiers

FIG. 3 shows a side view of the dispenser 10 with the elevated guide bars 150 and the spring loaded flap opening bars 100 on the top tier 12 and the bottom tier 14.

Figure 4:
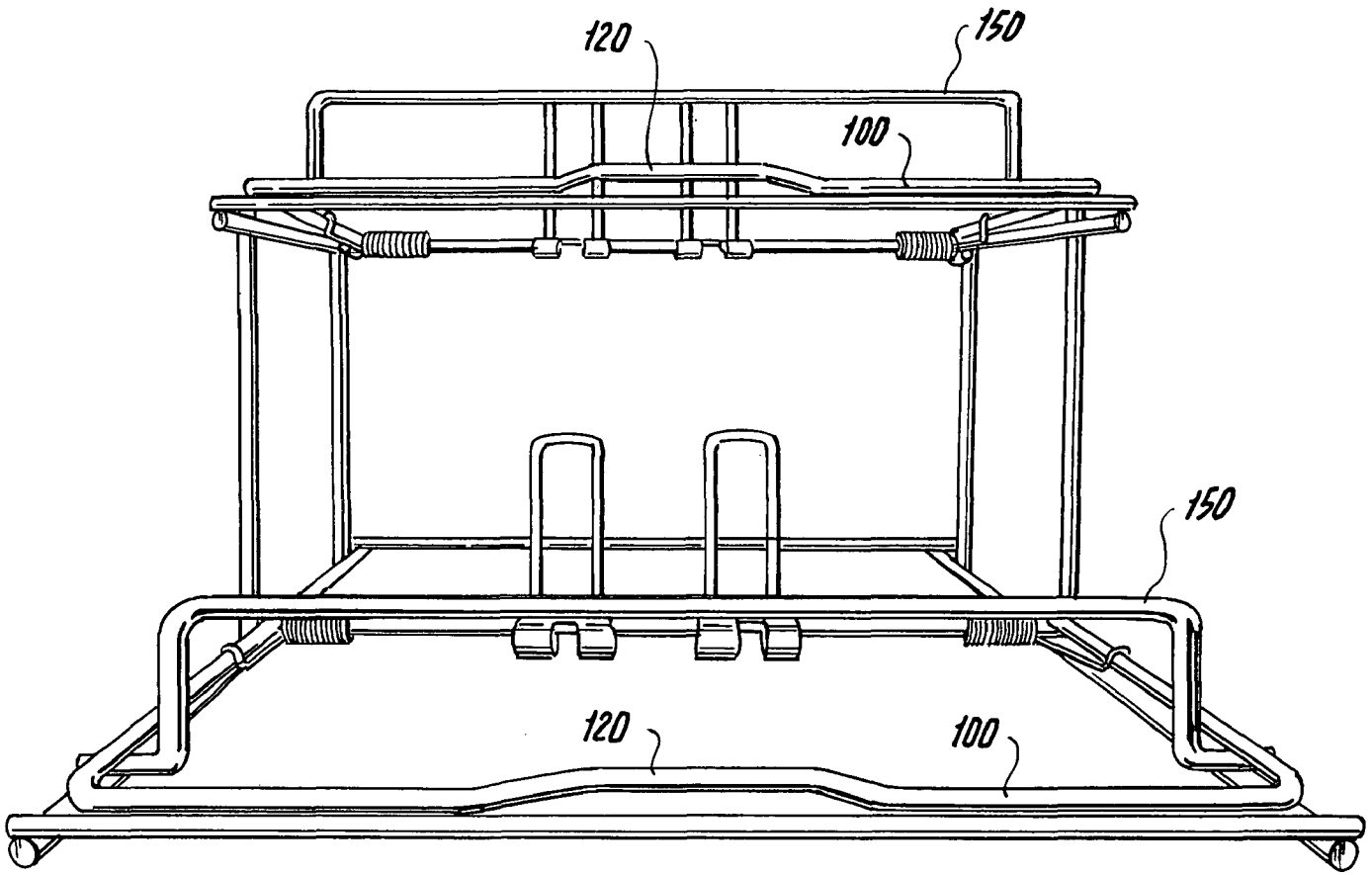
FIG. 4 shows a front view of the dispenser with the elevated guide bars and the offset center portion of the flap opening bars on the top and bottom tiers.

FIG. 4 shows a front view of the dispenser with the elevated guide bars 150 and the offset portion 120 of the flap opening bars 100 on the top tier 12 and the bottom tier 14.

Figure 5:
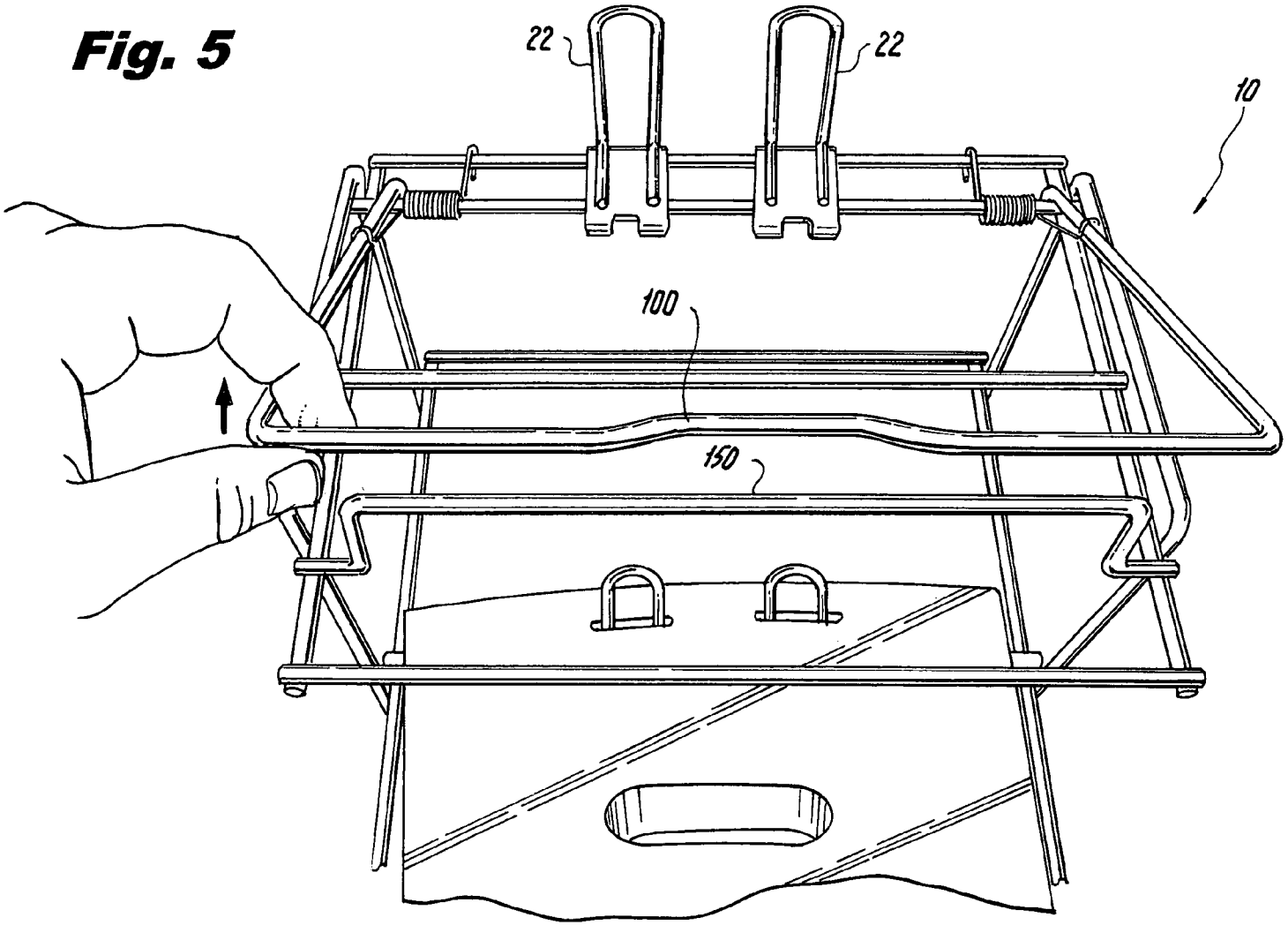
FIG. 5 shows the spring loaded flap opening bar being lifted to allow bags to be loaded onto the bag hooks.

FIG. 5 shows the spring loaded flap opening bar 100 being lifted to allow bags to be loaded over the guide bar 150, onto the bag hooks 22, and then under the flap opening bar 100 when it is released.

Figure 6:
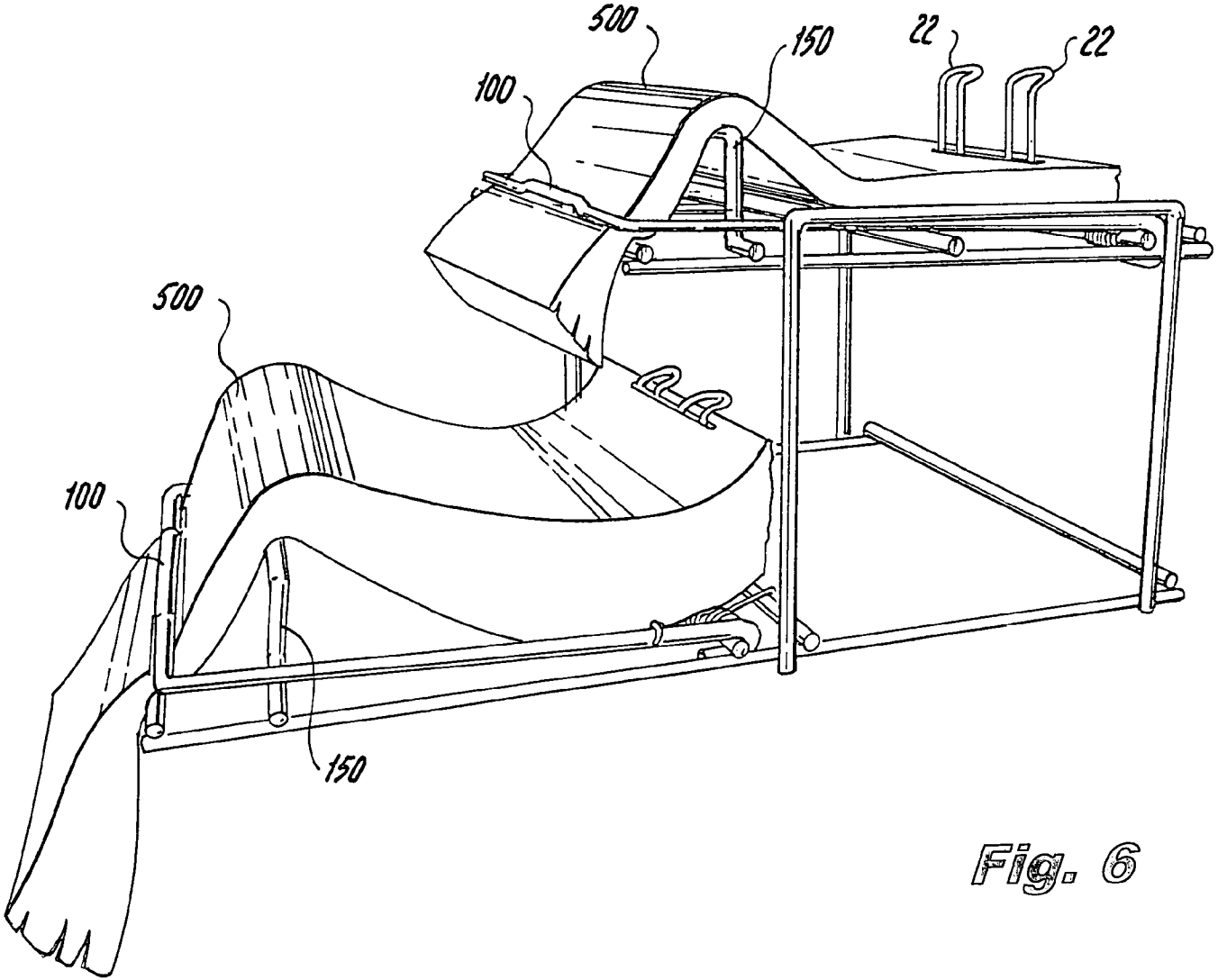
FIG. 6 shows the two sizes of bags correctly in place on the dispenser, on the bag hooks, over the elevated guide bar, then under the flap opening bar.

FIG. 6 shows two sizes of bags 500 correctly in place on the dispenser, with the bags on the bag hooks 22 on both the top and bottom tiers 12 and 14. The bags are draped over the guide bars 150 and under the flap opening bars 100 on both tiers.

Figure 7:
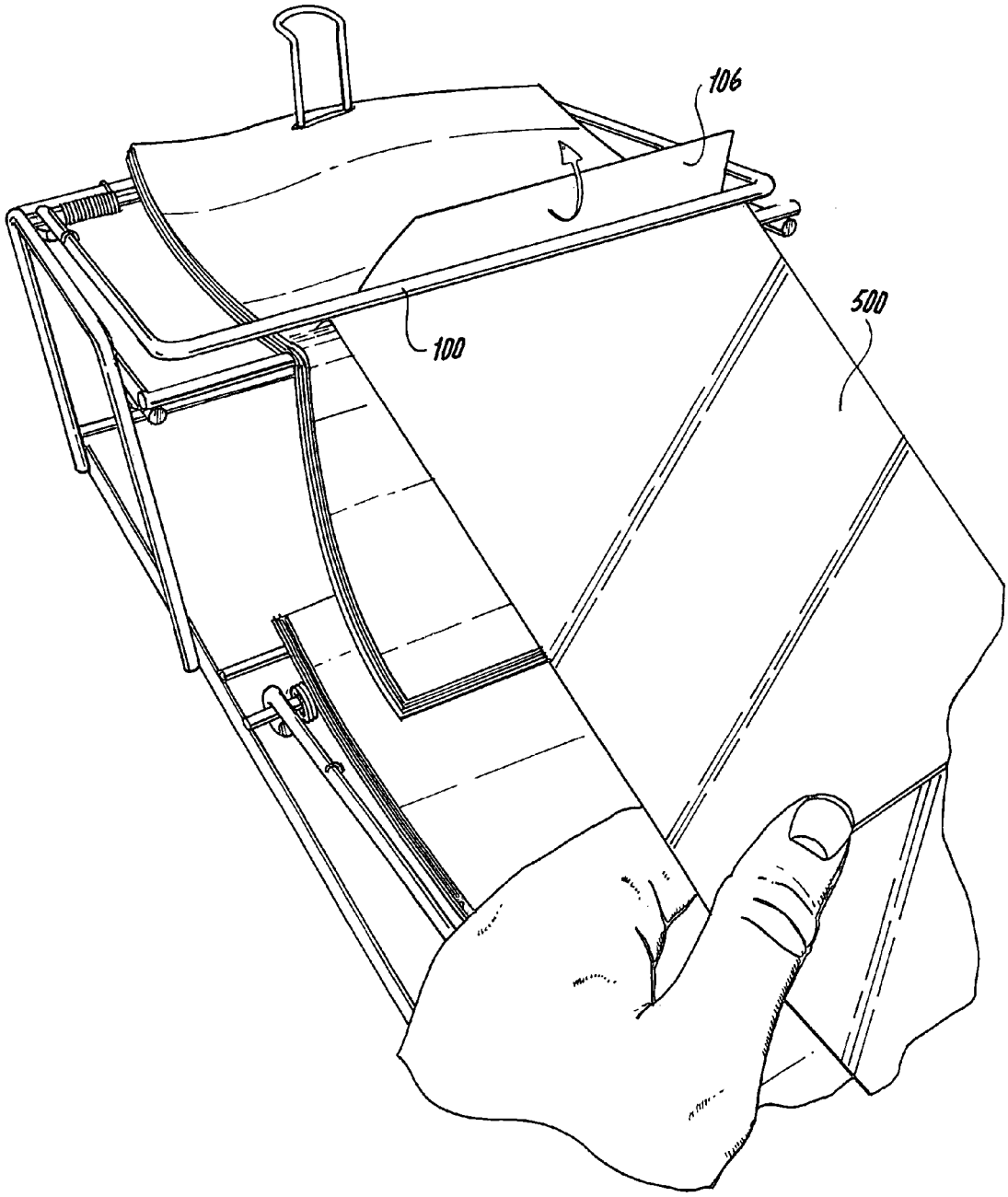
FIG. 7 shows the spring loaded flap opening bar lifting the flap of a bag as it is being pulled off the dispenser one at a time.
Figure 8:
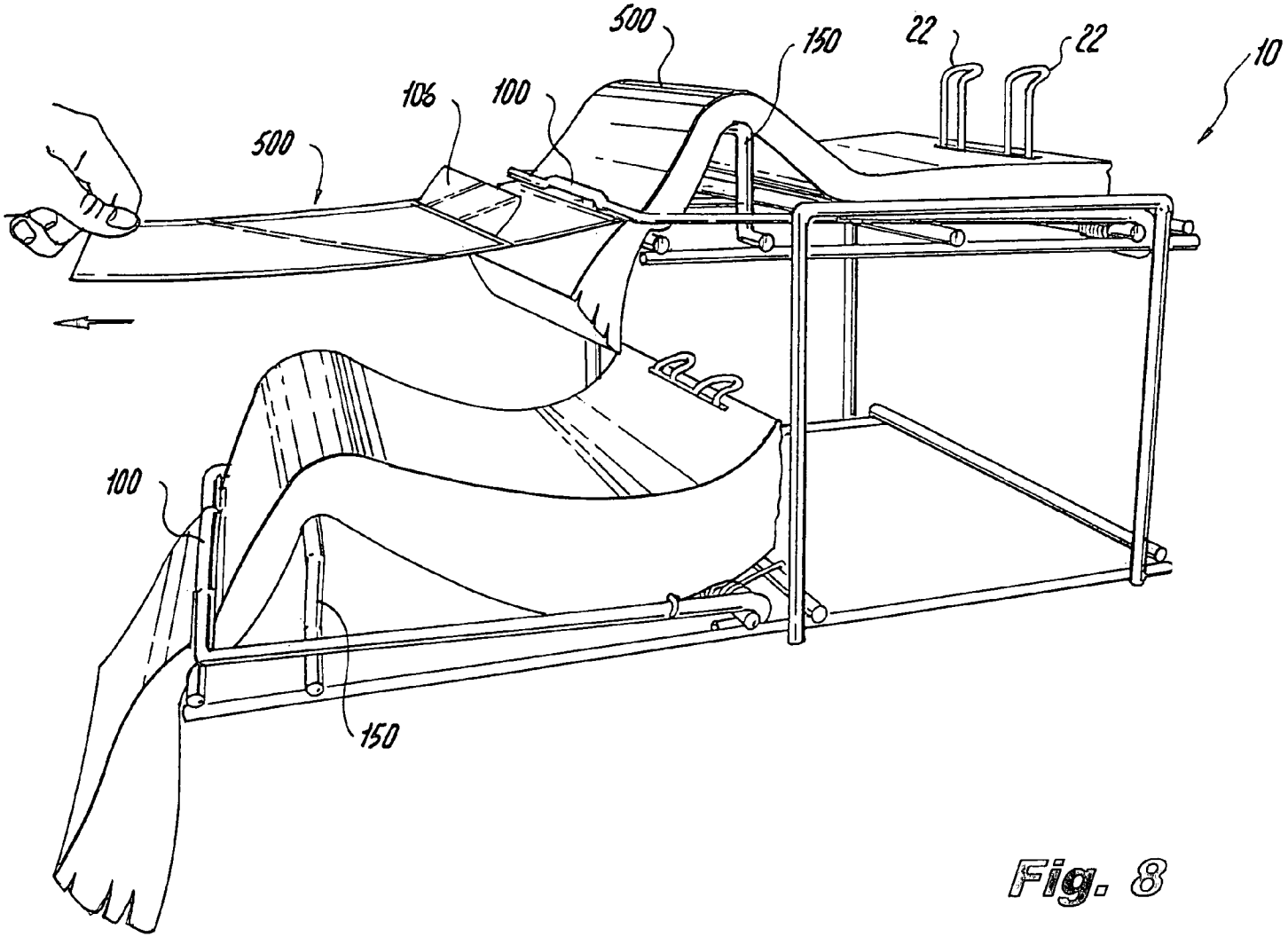
FIG. 8 shows the bag with the flap open after it has passed through the flap opening bar and is being released from the dispenser.

FIG. 7 shows the spring loaded flap opening bar 100 lifting the flap 106 of the bag 500 as the bag is being pulled under the bar and off the perforated header FIG. 8 shows how the flap 106 of the bag 500 stays open after the bag 500 is removed from the dispenser 10.

Figure 9:
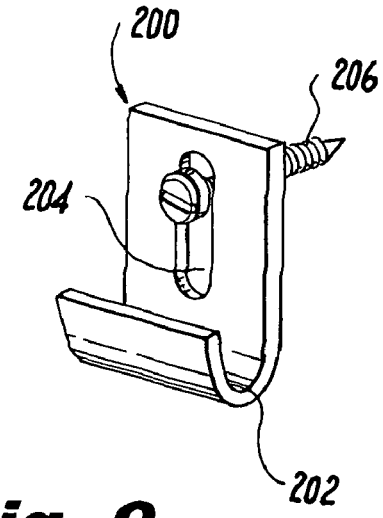
FIG. 9 shows a J hook used to secure the dispenser to any shelf, counter or wall surface.

FIG. 9 shows a "J" hook used to secure the dispenser to any shelf, counter or wall surface.

Figure 10:
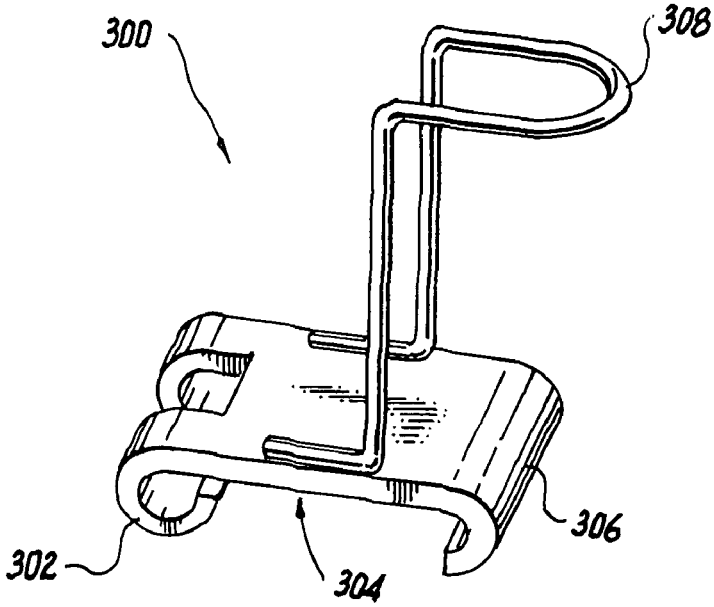
FIG. 10 shows a bag hook.

FIG. 10 shows a bag hook 300 similar to the bag hooks 22 shown above.

A plurality of hook members 300 as shown in FIG. 10 are provided to be removably mounted on the rail members of the dispenser 10. A preferred embodiment of the hook member 300 is shown in FIG. 10. The hook member 300 has a grasping portion 304 including a rod grasping member 306 and a curved lip portion 302. The rod grasping member 306 is adapted and arranged to grab at least one of the adjacent rail members disposed substantially parallel to each other as shown in FIG. 1. The curved lip portion 302 is located at a distance from the rod grasping member 306 and arranged so that the curved lip portion 302 engages with at least one of the other rail members of the adjacent rail members.

Although rail members are shown to be disposed in sets of pairs and the hook member 300 is preferably arranged to grasp one set of pairs of rail members, many alternative arrangements of the rail members and the hook members are possible. The grasping part 304 of the hook member 300 can include alternative structure that is capable of grasping one or more of the rail members so as to secure the rack member 300 to the dispenser 10.

The hook member 300 also includes a hook portion 308 which is preferably formed by at least two substantially parallel rod members. The hook portion 308 can be arranged to accommodate any type of article to be supported and dispensed.

The above-described structure of the hook member 300 and the arrangement of the rail members allow a plurality of hook members 300 to be easily and quickly mounted and removed from the dispenser. This allows the dispenser to provide any number of supporting configurations because any number of hook members can be mounted on any location of the rail members.

FIG. 9 shows a preferred embodiment of a mounting member 200 for mounting a dispenser on a support surface. The mounting member 200 includes a rail supporting member 202 which is shaped to support one of the rails. The mounting member 200 also includes a hole 204 for receiving a fastener

206 such as a nail or screw. Mounting foam or any other suitable mounting device may also be used. The mount hole 204 is positioned on a horizontal or vertical support surface so as to mount the dispenser 10 on that surface. With the mounting member 200, one or more racks can be mounted on a wall, counter, under counter or any other suitable location.

The invention has been described by reference to detailed examples and methodologies. These examples are not meant to limit the scope of the invention. Variations within the concepts of the invention are apparent to those skilled in the art. The disclosures of the cited references throughout the application are incorporated by reference herein.

The invention claimed is:

1. An apparatus for supporting and dispensing bags comprising:

a dispenser comprising a bag supporting surface;

a member attached to said bag supporting surface for holding a plurality of bags;

said bags having a flap covering an opening on a single side of said bag; and a spring loaded bag flap opening bar for opening said flap;

an elevated guide bar behind the bag flap opening bar, said elevated guide bar providing friction to assist bag flap opening bar in opening said flap of said bag said member comprising a hook member which is mounted on and removed from a body portion of said dispenser; and whereby the opening is drawn to an open position as a bag is pulled off said dispenser one at a time.

2. The apparatus of claim 1 wherein said bag supporting surface a plurality of interconnected rails.

3. The apparatus of claim 2 wherein said rails are arranged in multiple groups of two rails, a hook member arranged to be attached to each of said groups of two rails.

4. The apparatus of claim 3 further comprising:

a second member attached to a second set of rails.

5. The apparatus of claim 2 wherein said rails provide elevation to said dispenser so that hook members are removed and attached to said dispenser without interfering with surface beneath said dispenser.

6. The apparatus of claim 1 wherein said bags are plastic bags.

7. The apparatus of claim 1 further comprising a mounting device for mounting said apparatus on a supporting surface.

8. The apparatus of claim 1 wherein said hook member comprises at least one rod grasping member and a curved lip portion for storing a plurality of bags.

9. The apparatus of claim 1 wherein said bags are bags for prescriptions.

10. The apparatus of claim 1 wherein said dispenser supports and dispenses a plurality of different size bags.

11. The apparatus of claim 1 wherein said body portion is formed by a plurality of pairs of rails extending between end portions of said dispenser.

12. The apparatus of claim 1 wherein said hook member snap fit onto adjacent rails for removal and remounting.

13. The apparatus of claim 1 wherein said hook member is placed in a variety of positions on adjacent rails to adjust to different size lengths and widths of said bags.

14. The apparatus of claim 1 wherein said dispenser comprises a one piece construction with two tiers.

15. The apparatus of claim 14 wherein said bag flap opening bar is located on each of said two tiers.

16. The apparatus of claim 1 wherein said bag flap opening bar comprises a spring loaded bag flap opening bar with an offset center portion which does not come in contact with said bags.

17. The apparatus of claim 1 wherein said bag has tear-off perforations.

18. The apparatus of claim 1 wherein said bag has slits above said tear-off perforations so that said bag is hung on said hook members.

19. The apparatus of claim 1 wherein said dispenser is comprised of steel, aluminum, any other suitable metal, plastic, or wood.

20. The apparatus of claim 1 wherein said dispenser has a recessed portion, wherein said dispenser is placed on a counter or shelf with said recessed portion of said dispenser is placed at the front.

21. The apparatus of claim 1 wherein said dispenser is for holding bags which have a flap located on a single side of said bag which when opened, objects are placed inside said bag.

22. A method of supporting and dispensing bags comprising:

loading bags on a dispenser;

lifting a bag flap opening bar and placing said bags underneath said bag flap opening bar;

placing said bags on a hook member;

placing bags over a guide bar;

pulling said bags under said bag flap opening bar;

lifting a flap covering an opening located on a single side of pulled off said dispenser one at a time said bags in order to place the opening in an open position as said bags are.

* * * * *